US007516700B1

(12) United States Patent
Callaway

(10) Patent No.: US 7,516,700 B1
(45) Date of Patent: Apr. 14, 2009

(54) INFRA-RED EMITTING DECOY FLARE

(75) Inventor: James Callaway, Farnborough (GB)

(73) Assignee: The Secretaryof State for Defence in Her Britannic Majesty's Government of the United Kingsom of Great Britain and Northern Ireland, Farnborough, Hants (GB)

( * ) Notice: Subject to any disclaimer, the term of this patent is extended or adjusted under 35 U.S.C. 154(b) by 1826 days.

(21) Appl. No.: 08/628,053

(22) Filed: Apr. 10, 1996

(30) Foreign Application Priority Data

Apr. 18, 1995 (GB) ..... 9507920.8

(51) Int. Cl.
*F42B 12/70* (2006.01)

(52) U.S. Cl. ..... 102/334; 102/505; 428/113; 250/504 R

(58) Field of Classification Search ..... 102/334, 102/505; 428/113; 250/504
See application file for complete search history.

(56) References Cited

U.S. PATENT DOCUMENTS 3,983,816 A * 10/1976 Cornia et al. ..... 102/343
4,708,913 A * 11/1987 Baldi ..... 149/5 X
4,880,483 A * 11/1989 Baldi ..... 149/6
5,074,216 A * 12/1991 Dunne et al. ..... 102/334
5,129,323 A * 7/1992 Park ..... 102/293
5,470,408 A * 11/1995 Nielson et al. ..... 149/109.6

* cited by examiner

*Primary Examiner*—James S Bergin
(74) *Attorney, Agent, or Firm*—Nixon & Vanderhye P.C.

(57) ABSTRACT

An infra-red emitting decoy flare comprising a rupturable container 13 housing combustible flakes 1 and ignition means 20 for igniting the combustible flakes 1. Each of the combustible flakes 1 comprises a fibrous, carbon containing substrate on to which has been vapor deposited on one or both faces thereof a combustible material layer which is capable, in use, of igniting substantially simultaneously the entire surface onto which it is deposited.

24 Claims, 4 Drawing Sheets

INFRA-RED EMITTING DECOY FLARE

BACKGROUND OF THE INVENTION

1. Field of the Invention

The present invention relates to an infra-red (IR) emitting decoy flare and in particular to a decoy flare capable of generating an IR interference cloud to divert an incoming missile equipped with an IR seeker system away from its intended target.

2. Discussion of Prior Art

One known decoy flare which is used to provide such an interference cloud is described in the patent U.S. Pat. No. 4,624,186. This flare comprises a casing containing combustible flakes and an ignition expediting material. These combustible flakes comprise a thin base material, such as paper or metal foil, on to which is pressed a phosphorous containing incendiary paste. In use, the ignition expediting material creates a fireball which passes through the combustible flakes, igniting the incendiary paste which burns to emit IR radiation. Seeker systems on incoming missiles may detect this IR radiation and be deflected from their target and toward the IR interference cloud.

One problem with this known flare is that in addition to the production of IR emission the burning phosphorous containing incendiary paste also produces visible and ultra violet (UV) emission. Some "intelligent" seeker systems can use this UV emission when deciding to ignore some IR resources and therefore not deflected from their initial target by such flares. Furthermore, some missile systems, for example ones often employed in ground based anti-aircraft batteries, require human operators to make an initial target acquisition for a particular missile before the IR seeker system of that missile guides it to its acquired target. This target acquisition is often done visually and hence, particularly at night, illumination of the target by the visible emission from the decoy flare is undesirable.

One further problem associated with the known flare is that phosphorous has a characteristic IR emission spectrum which again some "intelligent" seeker systems use when deciding which IR source to ignore.

SUMMARY OF THE INVENTION

It is an aim of the present invention to provide a decoy flare which alleviates at least some of the aforementioned problems.

According to the present invention there is provided an infra-red emitting decoy flare comprising:

(a) a rupturable container;

(b) combustible flakes disposed within the rupturable container, wherein each of the combustible flakes comprises a fibrous, carbon containing substrate having vapour deposited on substantially all of the surface of one or both faces thereof a combustible material layer, the layer being capable in use of igniting substantially simultaneously the entire surface on which it is deposited, and (c) ignition means for igniting the combustible flakes.

In use the container is deployed into the air where the ignition means ignites the combustible material layer of the combustible flakes which then flash ignites the surface of the substrate on which it is deposited to expose a burning surface of the substrate which then continues to burn to act as an IR radiation emitter. The container is then ruptured to dispense the burning combustible flakes which forms an IR interference cloud capable of diverting an incoming missile equipped with an IR seeker system.

Visible and UV radiation associated with the burning combustible flakes is reduced, as compared with that of the known decoy flare, to below the useful level for intelligent seeker systems or human operators.

Moreover, the burning carbon of the carbon containing substrate emits an almost "black-body" intensity distribution of IR radiation which is substantially similar to that distribution generated by hot metal parts of a target which is proximal to the target's exhaust. This enables the flare according to the present invention to act as a decoy against intelligent seekers which 'look' for characteristic IR emission spectrum of phosphorous. Additionally, the combustion of the carbon in air produces carbon monoxide and carbon dioxide gaseous emissions which are characteristic of burning aviation fuel. This enables the flare according to the present invention to act as a decoy against intelligent seekers which are known to 'look' for the characteristic gaseous emissions A further advantage of the present decoy flare is that the carbon of the carbon containing substrate is electrically conducting so that the IR radiation cloud may also act to reflect incident RADAR radiation, thereby serving as protection against RADAR guided missiles.

In order to enhance the RADAR reflection from the IR radiation cloud the electrically conducting fibrous, carbon containing substrate of the combustible flakes may additionally comprise electrically conducting ribbon or wire, for example aluminum wire, situated at or near the surface and adapted to separate therefrom after a predetermined time to provide discrete pieces of electrical conductor. These pieces may then act as an electric dipole to conduct incident RADAR radiation. Preferably the length of these discrete pieces are tuned to the wavelength of the RADAR thereby maximizing the absorption. This may be achieved by using individual pieces of a suitable length or by using a single length having weaknesses, for example fractures, therein being designed to fail to provide discrete pieces when subjected to the heat generated by the burning substrate for a predetermined time.

The time at which these pieces separate from the substrate may be controlled for example by the depth within the substrate at which the conductor is placed or by bonding the conductor to the surface of the substrate with a bonding agent adapted to fail when subjected to the heat generated by the burning substrate for a predetermined time.

It will be appreciated by those skilled in the art that different targets often require decoy flares which provide for different emission characteristics. Fast moving targets, for example aeroplanes, often require a fast burning, high intensity decoy cloud for their protection whereas slower moving targets, for example large ships, often require a more slowly burning decoy cloud.

As the duration of burning of the substrate and hence its emission characteristics, such as the wavelength and intensity distribution of the IR radiation, can be controlled to some extent by regulating the carbon content of the substrate then so can the IR emission properties of the associated interference cloud. Clearly it is essential that the substrate of the current invention remains for a period of time after the consumption of the combustible layer and it has been found that in order to achieve this the carbon content of the substrate must lie in the range of between 20 $g/m^2$ and 400 $g/m^2$ and should preferably lie in the range of between 50 $g/m^2$ and 150 $g/m^2$ . Suitable substrates may comprise a consolidated layer of fibres, for example as in a felt or a woven carbon cloth such as carbonised rayon textile. Moreover the high degree of control over the physical characteristics of the combustible layer offered by vapour deposition enables the emission properties of the pyrotechnic material to be reliably reproduced.

A further advantage of vapour deposition is that it maximises the intermingling of the carbon content of the substrate and the combustible material layer at the interface to provide a large, intimate contact area between the two since the combustible material layer is deposited directly to individual, exposed fibres of the substrate which contain, or are covered with, carbon.

The resulting pyrotechnic material exhibits considerable resistance to spontaneous ignition. However, largely because of this intimate contact, the controlled ignition of the combustible layer at any selected location spreads substantially simultaneously across the entire layer. Intimate interfacial contact, and consequentially the ignition transfer through the combustible layer, is further enhanced by the nature of vapour deposition processes which are conventionally conducted in essentially oxygen-free environments such as a vacuum or a low pressure inert atmosphere, so preventing any inhibiting film of oxide which may form between the combustible material layer and the carbon containing substrate. Furthermore, vapour deposition ensures that the advantageous properties of the textile type substrate base material (such as flexibility, strength, and toughness) are not substantially degraded during the manufacture of the pyrotechnic product.

The thickness and composition of the combustible material layer is selected to ensure reliable and rapid progression of the ignition through the combustible layer and to generate sufficient energy to establish combustion of the substrate surface. If the layer is too thick, the reaction may self progress too slowly to provide the required rapid ignition of the substrate, this being due to excessive heat conduction from the interface into the combustible material layer itself. Whereas if too thin then insufficient heat will be generated by the combustion of the layer to ignite the substrate. For this reason the combustible material layer thickness deposited on one or both faces of the substrate should be between 5 microns and 200 microns per face and most preferably between 20 microns and 80 microns per face. Since the substrate is both porous and compressible then measurement of the thickness of any layer actually deposited onto the substrate may be inaccurate. The layer thicknesses quoted herein are therefore actually the thickness of layers contemporaneously deposited onto a non-porous reference substrate, for example an adhesive tape, placed within the deposition chamber together with the fibrous, carbon containing substrate.

Combustible metallic materials are particularly suitable for use as the combustible material layer since when deposited using a vapour deposition process the metallic materials form a highly porous layer. This porous layer provides a greatly enhanced surface area over which the oxidation reaction can occur and so facilitates the rapid spread of ignition through the combustible layer.

The combustible metallic layer may comprise a single metal, two or more metals deposited either as separate layers, as an alloy or as an intermetallic or any combination of individual alloy/metal/intermetallic layers. Alternatively, thermite type multi-layers may be used which comprise alternate layers of metal and metal oxide, the oxide being formed by regulating oxygen fed into the reaction chamber of a vapour deposition system, and may for example consist of alternating layers of aluminum and iron oxide.

Irrespective of how the metallic material combustible layer is constituted the selected metal is preferably one which reacts rapidly in air to generate sufficient heat when ignited to initiate the burning of the carbon containing substrate. Because of this and its ready availability, it is particularly preferred that the combustible layer comprises magnesium. The metallic material layer may comprise an alternative metal or an alloy thereof, particularly metals known to react vigorously with air, such as aluminum, boron, beryllium, calcium, strontium, barium, sodium, lithium and zirconium. A layer of magnesium or magnesium alloy of between 40 microns and 60 microns thick per face, is especially preferred, for example deposited on to one or both faces of a carbonised viscose rayon textile.

In order to extend the storage life of the IR emitting decoy flare and to stablise the ignition properties of the combustible flakes a protective layer may be deposited on top of the combustible material layer. This protective coating may suitably consist of a vapour deposited layer of a less reactive metal, for example titanium or aluminum (in cases where a more easily combustible metal is used, for example magnesium), of between 0.1 microns and 10 microns thick and preferably no more than 1 micron thick or may consist of a non-metallic coating deposited onto the combustible material layer using conventional spray or dip deposition techniques.

Most usefully the combustible flakes may additionally comprise an oxidant deposited onto the substrate. This oxidant provides a source of oxygen which is available to enhance the speed of ignition transfer through the combustible layer, to enable the substrate to continue to burn in conditions where the atmospheric oxygen is limited (for example if the flakes are ignited inside an air tight container); and to control, to some extent, the burn time and hence the IR emission characteristics of the substrate.

Where the substrate comprises a consolidated layer of fibres, such as in a carbon cloth, which is able to absorb liquid then it is convenient to deposit the oxidant onto the substrate in solution. Suitable oxidants are water soluble inorganic salts such as metal nitrates, nitrites, chlorates and perchlorates. For example where carbon cloth is passed through a 5% w/w aqueous solution of potassium nitrate its burn time is reduced but if passed through a 5% w/w aqueous solution of potassium phosphate its burn time is increased.

The rupturable container from which the combustible flakes are dispensed may be of the type commonly used in prior art decoys, for example that described in U.S. Pat. No. 4,624,186, which generally comprises an open ended can which is closed by a removable lid so that in use the lid is blown off either by the gas pressure generated by the burning combustible flakes or by a delay charge, usually designed to explosively remove the lid subsequent to the ignition means igniting the flakes.

Alternatively, a moveable sabot disposed internally of the open ended can and around the combustible flakes and co-operating propulsion means may be employed to remove the lid. This arrangement has the advantage that the sabot is able to protect the flakes against possible crushing as the lid is removed which may otherwise result in the compacting of flakes into clumps of burning IR emitting material. The propulsion means may, for example, comprise a spring loaded or explosively driven piston which in use is adapted to drive the sabot against the lid to effect its removal.

BRIEF DESCRIPTION OF THE DRAWING

An embodiment of the IR emitting decoy flare according to the present invention will now be described, by way of example only, with reference to the drawings of the accompanying figures where.

DETAILED DISCUSSION OF PREFERRED EMBODIMENTS

Figure 1:
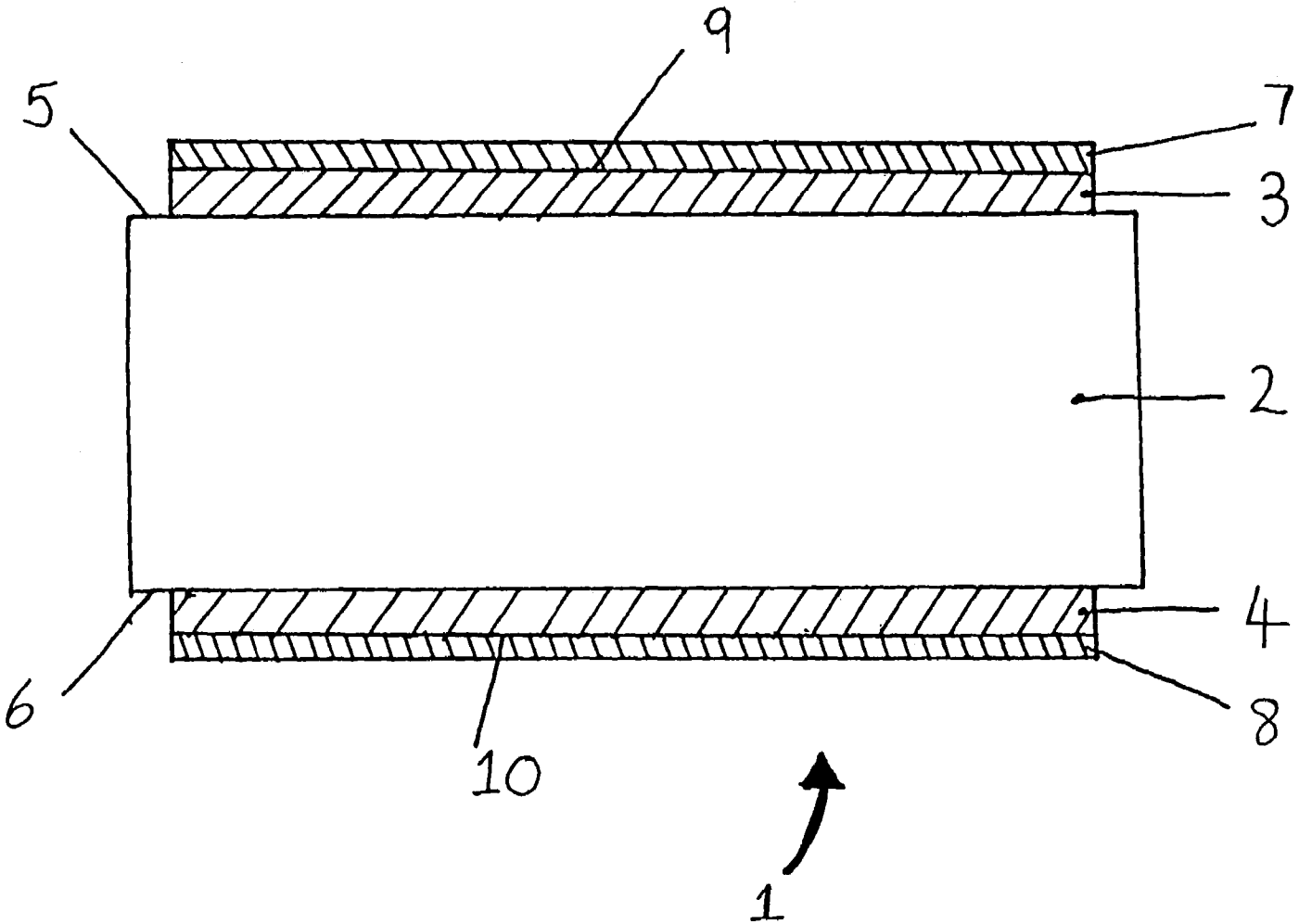
FIG. 1 shows a part sectioned view of a combustible flake.

Referring now to FIG. 1, combustible material flake 1 consists of a carbonised viscose rayon substrate 2 having combustible layers 3, 4 each consisting of approximately 40 microns thick magnesium, vapour deposited onto substantially all of the surface of the respective faces 5, 6 thereof. Further layers 7, 8 of titanium as a protective coat are vapour deposited to a thickness of approximately 0.5 microns onto the exposed surfaces 9, 10 of the combustible layer 3, 4.

The substrate 2 is formed from a 2.5 cm×10 cm×150 micron, 110 g/m$^3$ fibre containing viscose rayon tape. The tape is then carbonised in the presence of a copper salt activating agent and a potassium salt oxidant precursor at around 1200° C. using a conventional pyrolysis carbonisation process comprising four stages:

precarbonisation, where physically adsorbed solvent, water or monomers are removed;

carbonisation (between 300 and 500° C.), during which oxygen, nitrogen and halogens are removed and conjugation and crosslinking occurs between the carbon units;

dehydrogenation (between 500 and 1200° C.), increasing the interconnection of the conjugated carbon;

annealing (above 1200° C.), where the material attains a more crystalline structure and defects are gradually removed.

The substrate 2 so formed is highly porous and has lead oxide as an oxidant absorbed therein.

The layers 3, 4, 7, 8 are deposited using conventional vacuum deposition equipment (not shown). The deposition source material may be located in a separate vaporising boat (not shown) and vaporised with by heating the board or by scanning the surface of the deposition source with an electron beam in an inert atmosphere such as argon gas. Alternatively, the source may comprise a bar of material which is subjected to magnetron sputtering or inductive coil evaporation.

Figure 2:
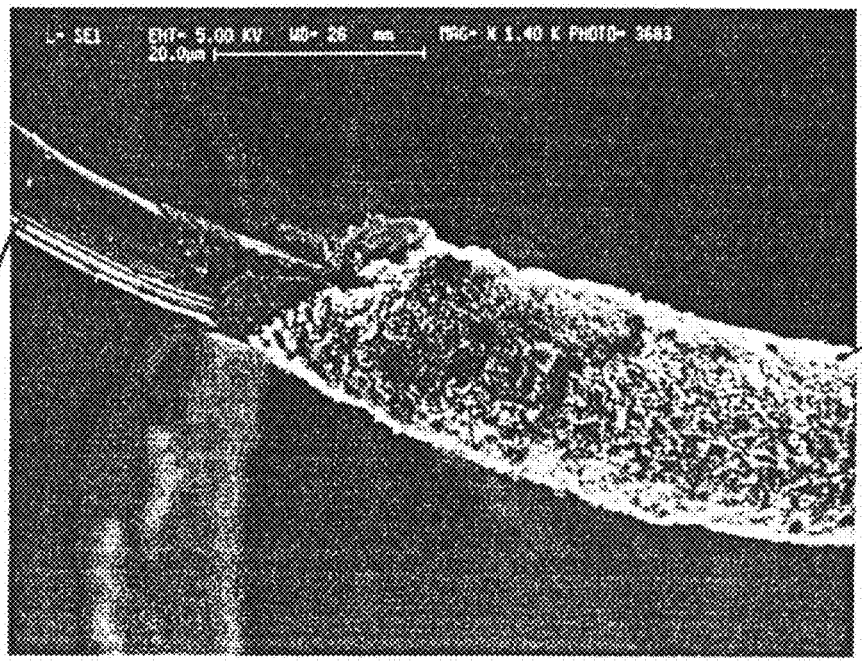
FIG 2 shows an electron micrograph of an exposed substrate fibre of the combustible flake of FIG. 1.

The magnesium is deposited directly onto the exposed surface of the substrate 2 to form the combustible material layers 3, 4. FIG. 2 is an electron micrograph×1400 magnification showing an exposed carbonised fibre 11 at the surface of the substrate having a radial deposit 12 of 5 microns of magnesium.

The combustible flake 1 thus fabricated may be edge-trimmed prior to use to remove any uncoated substrate 2.

Figure 3:
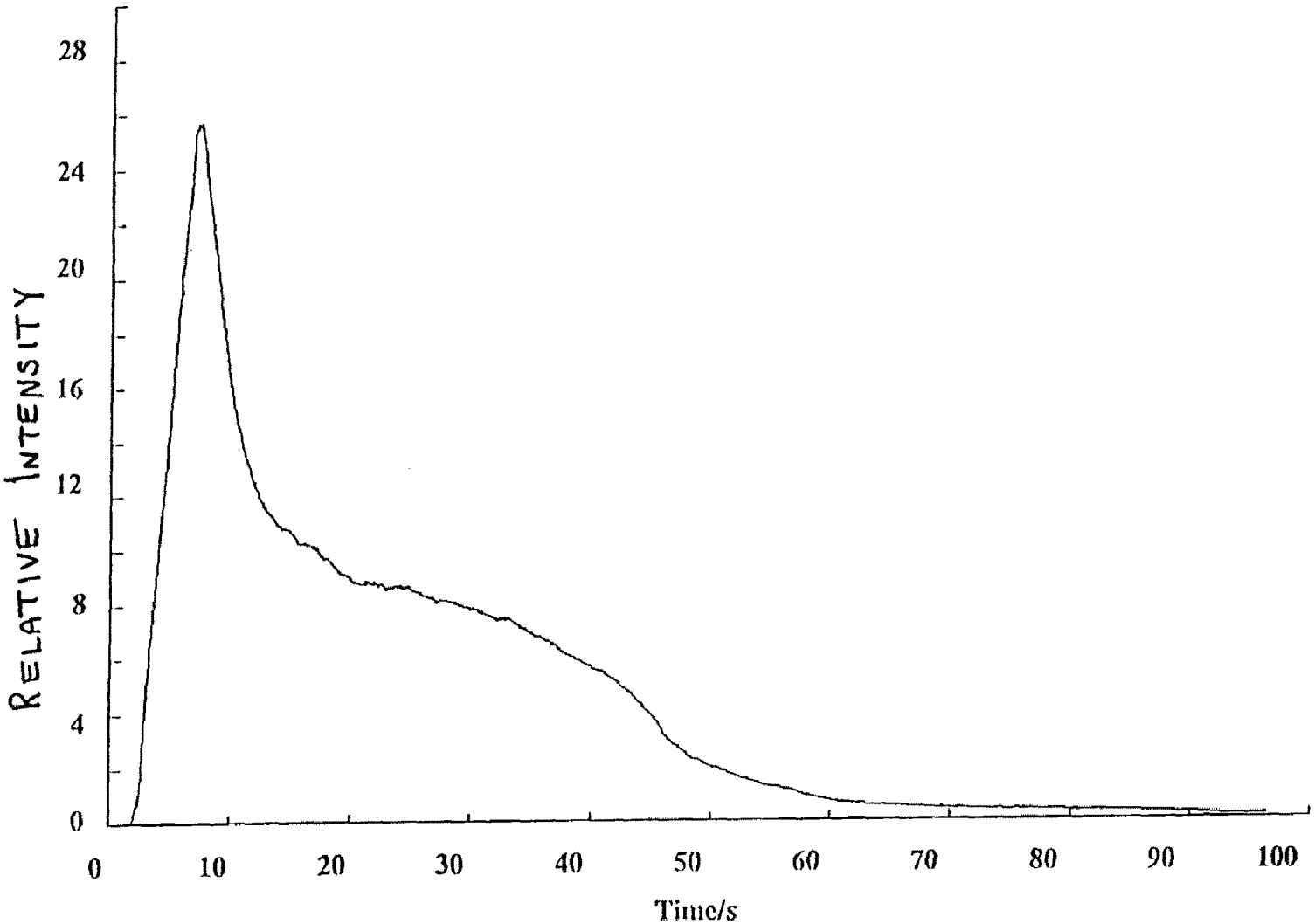
FIG. 3 shows the relative intensity variation in the total IR radiation output of the flake of FIG. 1 with time.

The typical variation in the intensity of the total IR radiation emission of the material shown in FIG. 1 with time is represented in FIG. 3. It can be seen from this figure that the flakes of this embodiment burn to emit useful IR radiation for a period of about 40 seconds.

Figure 4:
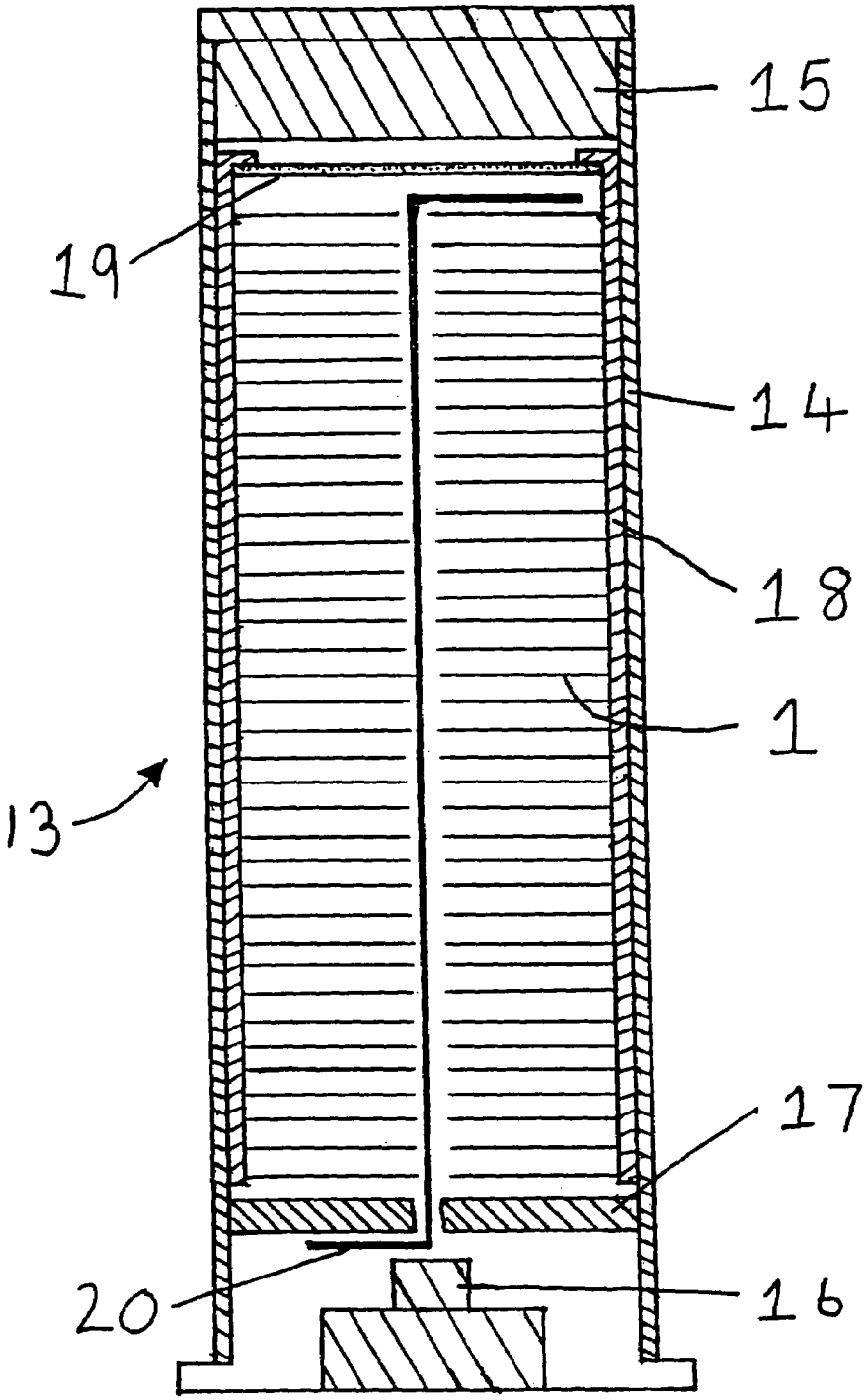
FIG. 4 shows a sectional view of a decoy flare store according to the present invention.

These flakes 1 are then packed into a rupturable container 13 to form the decoy flare shown in FIG. 4.

The rupturable container 13 comprises a casing 14 having an open end sealed by a lid 15 which is held in a push-fit engagement therewith. A sabot 18 is disposed internal of the casing 14 and surrounds the combustible flakes 1 and is provided with a combustible lid 19, fabricated, for example, from cardboard, which closes the end of the sabot 18 adjacent the lid 15. A squib 16, containing a pyrotechnic ejecting charge, and a piston 17 are situated within the casing 14 towards the end opposite the fluid 15 and constitutes a propulsion means for the sabot 18. The combustible flakes 1 here comprise discs of the fibrous, carbon containing substrate each having a central hole through which an ignition train 20 passes.

In use, the pyrotechnic ejection charge contained within the squib 16 is ignited, for example using a standard electrical igniter (not shown), to produce hot gasses. These gasses ignite the ignition train 20 and propel the piston 17 to drive the sabot 18 against the lid 15 which is pushed out of the casing 14 when subjected to a predetermined pressure from the sabot 18 and piston 17 to leave an open end through which the sabot 18 and the flakes 1 may then be ejected by the piston 17.

As the sabot 18 is driven against the lid 15 the ignition train 20 ignites the flakes 1 and the combustible lid 19 so that burning flakes 1 emerge from within the casing 14. Generally, dispersal of the flakes 1 may be altered by choosing a squib ejection charge or an ignition train 20 which generates more or less gas. If, for example, an ignition train 20 is used which comprises a material having a PTFE substrate coated with vapour deposited magnesium, as described generally in the UK patent GB 2 251 434 B, then little gas is generated and consequently the flakes 1 will be dispersed over a smaller area than if, for example, a magnesium/viton/teflon (MTV) ignition cord, commercially available from M. L. Aviation limited of Middle Wallop, Hampshire, England, is used which generates useful quantities of gas to increase the area over which the flakes 1 are dispersed.

The invention claimed is:

1. An infra-red emitting decoy flare comprising:

(a) a rupturable container;

(b) combustible flakes disposed within the rupturable container, wherein each of the combustible flakes comprises a fibrous, carbon containing substrate and a combustible material layer deposited on substantially all of the surface of one or both faces of the substrate with intimate interfacial contact between said combustible material and said fibrous carbon containing substrate; and (c) ignition means for igniting the combustible flakes.

2. A decoy flare as claimed in claim 1 wherein the carbon content of the substrate is between 20 g/m$^2$ and 400 g/m$^2$.

3. A decoy flare as claimed in claim 1 wherein the carbon content of the substrate is between 50 g/m$^2$and 150 g/m$^2$.

4. A decoy flare as claimed in claim 1 wherein the substrate comprises a consolidated layer of fibres.

5. A decoy flare as claimed in claim 4 wherein the substrate is formed from a woven carbon cloth.

6. A decoy flare as claimed in claim 5 wherein the woven carbon cloth is a carbonised rayon textile.

7. A decoy flare as claimed in claim 1 wherein the combustible material layer is between 5 microns and 200 microns thick.

8. A decoy flare as claimed in claim 7 wherein the combustible material layer is between 20 microns and 80 microns thick.

9. A decoy flare as claimed in claim 1 wherein the combustible material layer comprises a combustible metallic material having metals selected from the group magnesium, aluminum, boron, beryllium, calcium, strontium, barium, sodium, lithium and zirconium.

10. A decoy flare as claimed in claim 9 wherein the combustible layer comprises a layer of magnesium of between 40 microns and 60 microns thick.

11. A decoy flare as claimed in claim 9 further comprising a layer of less reactive metal vapour deposited onto the exposed surface of the combustible material layer.

12. A decoy flare as claimed in claim 11 wherein the layer of a less reactive metal consists of a layer of titanium or aluminum of between 0.1 microns and 10 microns thick.

13. A decoy flare as claimed in claim 11 wherein the thickness of the less reactive metal layer is no greater than 1 micron.

14. A decoy flare as claimed in claim 1 wherein the substrate incorporates an oxidant deposited thereon.

15. A decoy flare as claimed in claim 14 wherein the oxidant is a water soluble inorganic salt.

16. A decoy flare as claimed in claim 1 wherein the rupturable container comprises an open ended can having a removable lid, an internally disposed moveable sabot and propulsion means co-operable with the sabot for driving it against the removable lid.

17. A decoy flare as claimed in claim 16 wherein the propulsion means comprises an explosively propellable piston.

18. A decoy flare as claimed in claim 1, wherein the combustible material layer is a vapor deposited layer which is deposited on the fibrous, carbon containing substrate.

19. An infra-red emitting decoy flare comprising:

(a) a rupturable container;

(b) combustible flakes disposed within the rupturable container, where each of the combustible flakes comprises a fibrous, carbon containing substrate and a combustible material layer having a thickness of less than 200 microns deposited on substantially all of the surface of one or both faces of the substrate with intimate interfacial contact between said combustible material and said fibrous carbon containing substrate; and (c) ignition means for igniting the combustible flakes.

20. A decoy flare as claimed in claim 19, wherein said thickness is between 5 and 200 microns.

21. A decoy flare as claimed in claim 20, wherein said thickness is between 20 and 80 microns.

22. An infra-red emitting decoy flare comprising:

(a) a rupturable container;

(b) combustible flakes disposed within the rupturable container, wherein each of the combustible flakes comprises a fibrous, carbon containing substrate and a combustible material layer deposited on substantially all of the surface of one or both faces of the substrate with intimate interfacial contact between said combustible material and said fibrous carbon containing substrate; and (c) a flake igniter.

23. A decoy flare as claimed in claim 22, wherein said flake igniter comprises an ignition train comprised of a PTFE substrate coated with magnesium.

24. A decoy flare as claimed in claim 22, wherein said flake igniter comprises a magnesium/viton/teflon (MTV) ignition cord.

* * * * *